United States Patent [19]

Milligan

[11] 4,341,379

[45] Jul. 27, 1982

[54] SPOTTING DECK FOR A TRAMPOLINE

[76] Inventor: Michael R. Milligan, 1901 W. Main St., St. Charles, Ill. 60174

[21] Appl. No.: 172,186

[22] Filed: Jul. 25, 1980

Related U.S. Application Data

[63] Continuation-in-part of Ser. No. 949,787, Oct. 10, 1978, abandoned.

[51] Int. Cl.[3] ..... A63B 5/18

[52] U.S. Cl. ..... 272/65

[58] Field of Search ..... 272/65, 66, 70; 182/138–140

[56] References Cited

U.S. PATENT DOCUMENTS

| | | | |
|---|---|---|---|
| 2,799,867 | 7/1957 | Fenner et al. | 5/111 |
| 2,969,124 | 1/1961 | Nissen | 272/65 |
| 2,991,841 | 7/1961 | Sampson et al. | 182/139 |
| 3,004,623 | 10/1961 | Nissen | 272/65 |
| 3,233,895 | 2/1966 | Grelle et al. | 182/139 |
| 3,339,925 | 9/1967 | Nissen | 273/95 |
| 3,580,570 | 5/1971 | Fenner et al. | 272/65 |
| 3,767,009 | 10/1973 | Sidlinger | 272/65 X |
| 3,831,936 | 8/1974 | Watson et al. | 272/65 |
| 3,983,585 | 10/1976 | Sidlinger | 272/65 X |
| 4,139,192 | 2/1979 | McNeil | 272/65 |

FOREIGN PATENT DOCUMENTS

| | | |
|---|---|---|
| 724186 | 2/1955 | United Kingdom . |
| 937087 | 9/1963 | United Kingdom . |

OTHER PUBLICATIONS

Photograph of Stock Trampoline in Commercial use as of Date of Filing of Parent Application (U.S Serial No. 949,787).

Nissen Goliath 880 Trampoline Advertisement Brochure (1978).

Octopus Octagon Trampoline Advertising Brochure (1978).

Nissen Regulation 770 Advertising Brochure (data unknown).

*Primary Examiner*—Richard J. Apley

*Attorney, Agent, or Firm*—Hill, Van Santen, Steadman, Chiara & Simpson

[57] ABSTRACT

A trampoline as provided at its outer periphery with a substantially rigid spotting deck essentially coplanar with the resilient jumping or bouncing surface of the trampoline, and of a width sufficient to provide a place for instructors and/or those waiting to use the trampoline to stand and observe the user. The spotting deck may be covered with a shock absorbing foam covering, or alternatively with a rigid flat support platform, which is then in turn covered with the shock absorbing foam and may be employed on trampolines of any shape, particularly those shapes now commonly in use, e.g., rectangular, octagonal, and circular. The end spotting deck and associated supporting structure are attachable to the side frame members of a rectangular trampoline in place of a normal end structure for such a trampoline.

7 Claims, 9 Drawing Figures

Fig. 1
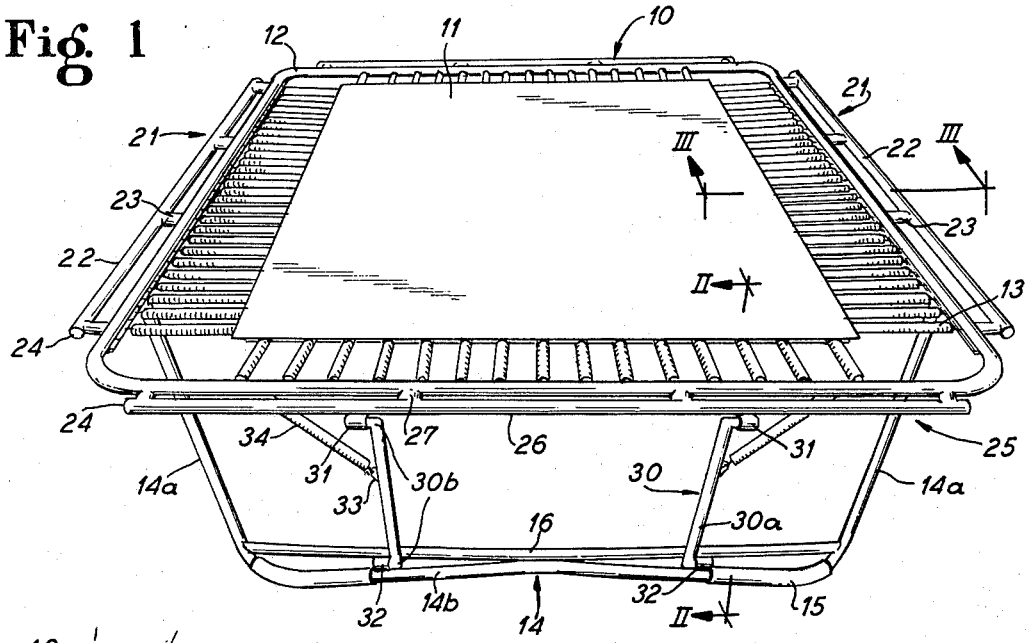
Fig. 2
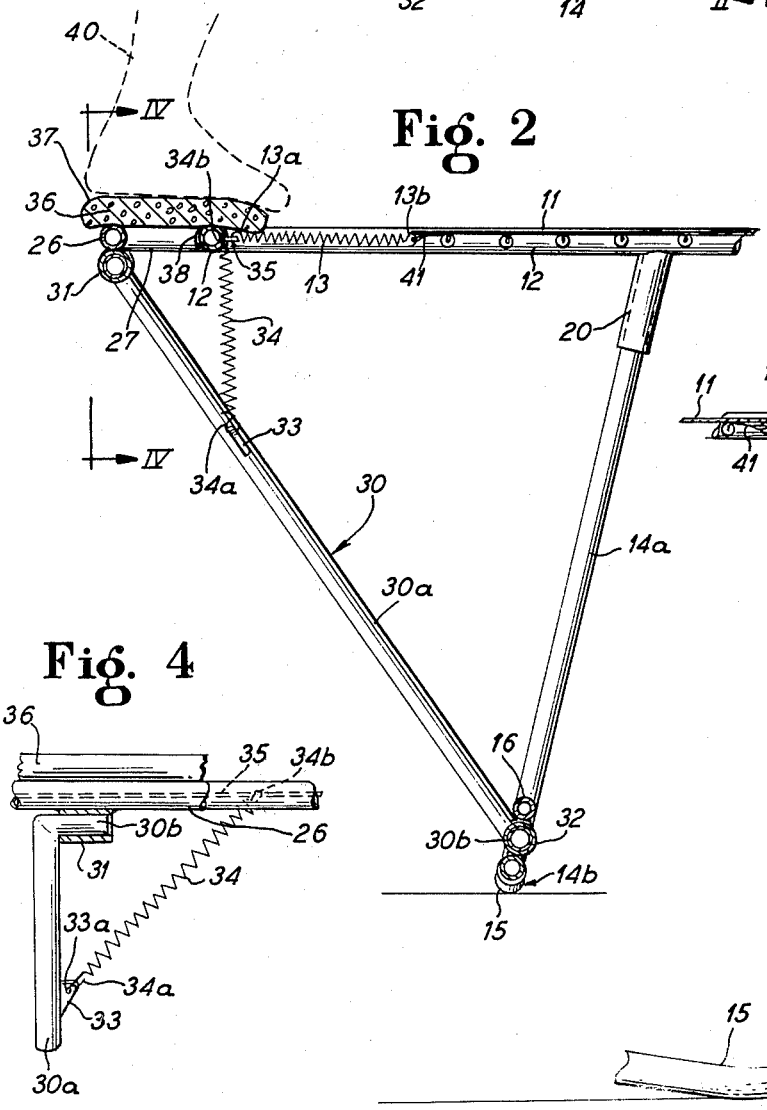
Fig. 3
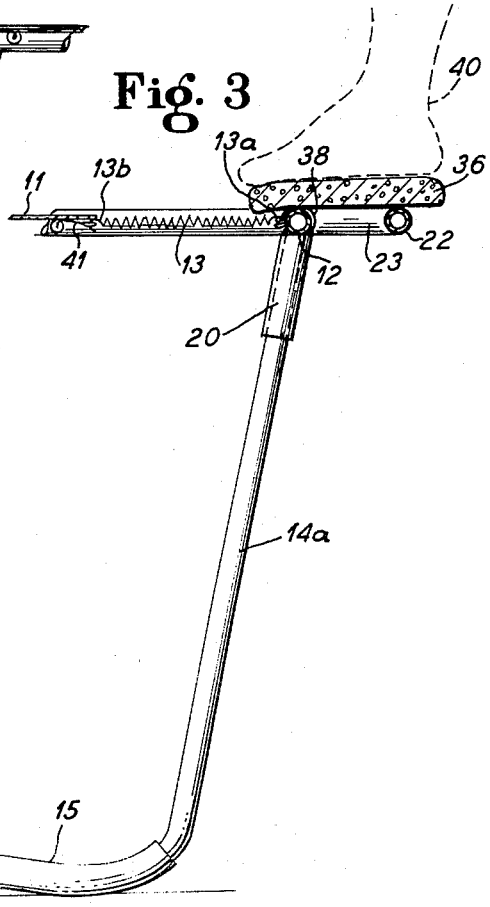
Fig. 4

SPOTTING DECK FOR A TRAMPOLINE

RELATED APPLICATION

This application is a continuation-in-part of my copending application Ser. No. 949,787, filed on Oct. 10, 1978, now abandoned.

BACKGROUND OF THE INVENTION

1. Field of the Invention

The present invention relates generally to recreational and exercise apparatus, and specifically to a spotting deck for use with a trampoline.

2. Prior Art

In the use of trampolines for recreational and exercise purposes, it is often desirable that instructors and users be able to stand at a level coplanar with the resilient jumping surface of the trampoline. In order to save time between users, it is desirable that the next user in sequence be able to immediately step onto the resilient surface after the first user has completed his or her time on the trampoline. Such entry onto the surface is more quickly facilitated if the second user can be waiting at a level substantially coplanar with the jumping surface, rather than having to mount the surface from ground level after the first user is finished.

From an instructional point of view, it is also desirable that students be able to view the trampoline user at a level substantially coplanar with the jumping surface, in order to better recognize good and bad technique. Instructors also employ various teaching apparatus, which is best effectuated when the instructors can be situated on a level with the user. One such instructional device is a belt which is worn by the trampoline user, said belt having two ropes pivotally attached thereto at either side, the other ends of the ropes being held by instructors or other students at each end of the trampoline. Such a device aids the beginning trampoline user in learning elementary trampoline gymnastics, and also lessens the possibility of injury due to an errant bounce, by allowing the rope-holders to keep the user in the center of the jumping surface.

A number of so-called viewing or spotting decks have been employed in the past in an attempt to effectuate the above goals.

The most common means currently employed of providing a coplanar viewing or instructional surface is the use of an independent structure which is situated adjacent to the trampoline. Such structures generally consist of a flat rigid surface, generally of rectangular shape and having dimensions of several feet in width. The surface is covered with a shock absorbing foam material, which is in turn covered with a tear resistant vinyl. The flat surface is supported on a tubular steel frame which is constructed so as to dispose the viewing surface coplanar with the resilient jumping surface of the trampoline. Any number of such viewing surfaces can be moved adjacent to the trampoline, to completely or partially surround the trampoline. Because such viewing structures are not integrally formed with the trampoline, they must be purchased, transported, assembled, and stored separately. In addition, when used with a non-rectangular shaped trampoline, such as a circle or an octagon, the rectangular viewing surfaces do not surround the trampoline, allowing gaps to be present between the viewing surface and the trampoline frame.

A rectangular trampoline, such as U.S. Pat. No. 3,767,009, employs covering material on the springs, but no spotting deck is embodied in the structure. Standing on such material covering the springs, of course, dampens the resiliency of the jumping surface, thereby lessening the height which the user can obtain using such a trampoline.

Trampolines known in the art are generally categorized as one of two types, the first being "institutional" trampolines which are generally of expensive and elaborate construction and frequently have non-rigid side rails which are hinged at a midpoint so that the trampoline can be collapsed and folded for storage. The supporting structure for such trampolines also employs a hinge or latch mechanism to allow the supporting structure to be moved against the remainder of the trampoline frame for storage. The other general type of trampoline is the so-called "backyard" trampoline which is generally of a rigid, non-bendable construction and must be disassembled for storage rather than folded. Such trampolines are generally of a simpler construction than the institutional trampolines and it is a problem in the art to provide an end viewing or spotting deck which can be easily attached to such a backyard trampoline which preserves the relatively simple construction of the trampoline and thereby does not appreciably add to the substantially lower cost of such backyard trampolines in comparison to institutional trampolines.

SUMMARY OF THE INVENTION

In accordance with the present invention, a spotting deck for a trampoline is integrally carried on the periphery of a trampoline frame, completely surrounding the bouncing surface. The deck is constructed of the same generally tubular metal which comprises the frame of the trampoline, and is rigidly attached thereto by any suitable means, such as welding. In a rectangular trampoline, the deck consists of an outer tubular foot supporting member, carried parallel to each of the four sides of the rectangle formed by the frame perimeter, and attached thereto by a plurality of connecting members disposed perpendicular to each side and each supporting member. The viewing decks at either end of the rectangle are further supported by upright tubular struts, having ends which are perpendicular to the upright portion thereof. The ends are carried in sleeves attached to the parallel supporting member or to the frame perimeter, and to a base of the frame of the trampoline. The supporting struts are held in the sleeves by tension springs attached at one end to the upright portion of the strut, and attached at another end to the perimeter of the frame. The connecting members may be of a width less than the length of the average user's foot, such that no further supporting means are necessary.

Alternatively the connecting members may be of a greater width, such that a firm supporting surface may be placed on top of the spotting deck. The deck itself, or the supporting platform, is covered with a shock absorbing foam, and a tear resistant vinyl. The deck may be disposed substantially coplanar with the resilient surface of the trampoline, or at a slightly inclined angle thereto in the range of 5° to 10°. A similar construction can be employed on trampolines of an octagonal or circular shape.

BRIEF DESCRIPTION OF THE DRAWINGS

FIG. 1 is a perspective view of a rectangular trampoline having viewing decks on all four sides.

FIG. 2 is a sectional view taken on line II—II of FIG. 1.

FIG. 3 is a sectional view taken on line III—III of FIG. 1.

FIG. 4 is a detail sectional view taken on line IV—IV of FIG. 2.

DESCRIPTION OF THE PREFERRED EMBODIMENTS

Figure 5:
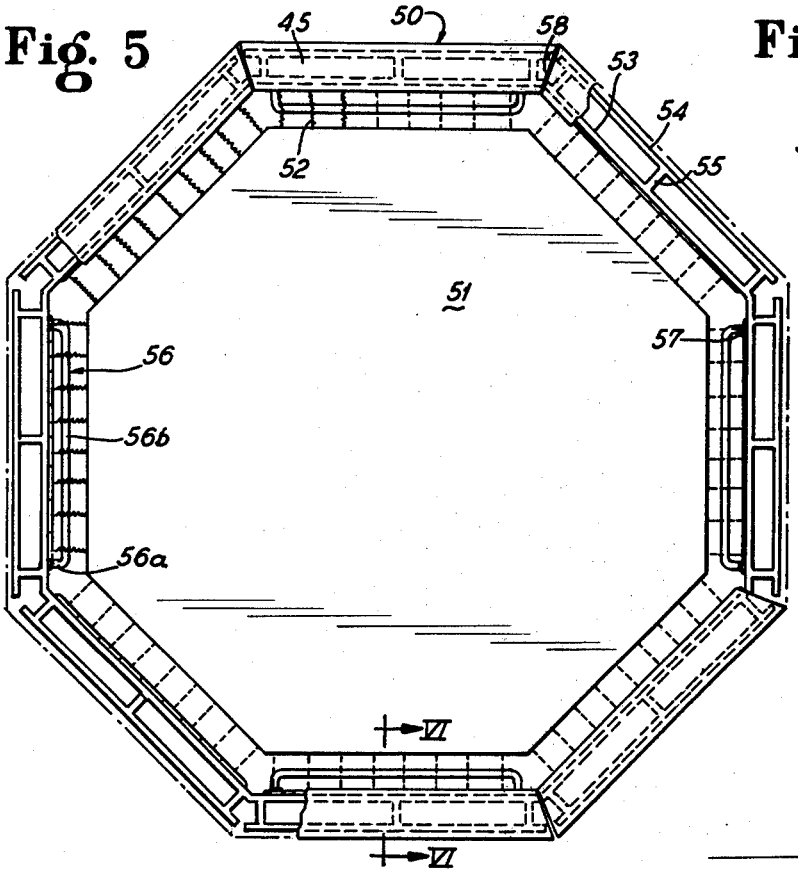
FIG. 5 is a plan elevational view of an octagonal trampoline having a viewing deck on each of its eight sides.

A rectangular trampoline 10, embodying the invention is shown generally in FIG. 1. The trampoline 10 has a resilient bouncing surface 11 supported by a rectangular perimeter frame 12, to which are attached a plurality of springs 13. The springs are of a length and tension such that when no force is exerted on the resilient surface the springs 13, perimeter frame 12, and resilient surface 11 are substantially coplanar. The springs 13 are attached to a plurality of loops 35 carried inwardly on perimeter frame 12, in each of which loops 35 an end 13*a* of the spring 13 is held, as shown in FIG. 2. The opposite end 13*b* of the spring 13 is attached to the resilient surface 11 by any suitable means, such as a reinforcing loop, shown as 41 in FIG. 2.

The perimeter frame 12 and the resilient bouncing surface 11 are supported substantially parallel to the ground by a pair of supporting members or legs 14. Each supporting member or leg 14 has a pair of generally upright segments 14*a* and a base segment 14*b*. The base segment 14*b* is slightly raised at its center, such that only a portion of the base segment 14*b* actually rests on the ground. The portions of the base segment 14*b* on which the trampoline rests are each covered by a rubber shod 15 which provides a frictional contact between the trampoline and any smooth surface on which it may rest, to prevent "walking" of the trampoline during use. The shod 15 is also of a resilience such that marring of surface on which the trampoline 10 rests will be minimized.

A strengthening bar 16 is attached to the upright portions 14*a* of the support member 14 and attached to the base portion 14*b* at its highest point. The uppermost ends of upright portions 14*a* of each supporting member 14 engage a sleeve 20, connected beneath, for example, by welding, and extending downwardly from the perimeter frame 12.

In accordance with the principles of the present invention, side viewing or spotting decks 21 are carried on the longer sides of the rectangular trampoline 10. The side viewing or spotting decks 21 consist of a tubular outer support member 22 disposed parallel to each of the longer sides of perimeter frame 12, and attached thereto by a plurality of connecting members 23. The hollow ends of outer support member 22 are covered by a cap 24 which is welded therein.

It is further contemplated by the present invention that the trampoline 10 be provided with end viewing or spotting decks 25, consisting of a tubular member 26, carried parallel to the shorter sides of perimeter frame 12, and attached thereto by a plurality of connecting members 27. The hollow ends of tubular member 26 are also covered by a cap 24 connected as by welding therein.

So-called backyard trampolines, of the type shown in FIG. 1, are assembled by attaching four rigid, one piece elements in perpendicular fashion by a sleeve or other insertion arrangement in order to form the rectangular perimeter frame 12. In heretofore known structures of this type, the portions of the frame 12 at the ends thereof, that is, the shorter sides of the rectangle, have simply been a continuation of the side rails with no additional structure, such as the spotting or viewing deck disclosed herein, and the associated supporting elements. As more fully described below, the present invention of an end spotting deck for such a trampoline can be attached to the side rails of conventional trampolines in place of the normal end piece which would ordinarily be utilized to complete the perimeter frame 12. The spotting and viewing deck structure disclosed herein can thus be simply and inexpensively integrated with otherwise conventional backyard trampoline structures during the manufacture thereof without anyretooling or other modification of the conventional structure. Because the advantages of backyard trampolines as opposed to institutional trampolines are the relatively simple and economic construction of backyard trampolines, the present invention allows attachment of an end spotting and viewing deck to such backyard trampolines while preserving the simple and relatively inexpensive overall design thereof. The supporting structure described below, however, while preserving the simplicity of design, still affords the proper stability of support necessary for safe use of the trampoline.

The end viewing or spotting decks 25 are further supported by a pair of supporting struts 30, disposed at each end of the trampoline 10. The struts 30 consist of an upright portion 30*a* and two end portions 30*b* which are disposed perpendicularly to upright portion 30*a*. The upright portion 30*a* also carries a flange 33 disposed on the same side of strut 30 as the ends 30*b*. The upper ends of each of the struts 30 each engage a corresponding sleeve 31, disposed below the tubular member 26, and attached thereto. The sleeves 31 are disposed so as to divide tubular member 26 into three portions of equal length. The sleeves 31 can be disposed in a similar position below a shorter side of perimeter frame 12. Placement of the sleeves 31 below tubular member 26, however, provides superior support for spotting decks 25. Lower ends of the struts 30 engage similar sleeves 32, disposed between the strengthening member 16 and the base portion 14*b* of the base 14. The strut 30 is held within the sleeves 31 and 32 by a tensioned spring 34, attached at one end 34*a* to a centrally disposed hole 33*a* in the flange 33, and attached at its other end 34*b* to one of the loops 35 carried on the perimeter frame 12. The tension in the spring 34 thus holds the strut 30 firmly in position during use, but allows removal of the strut 30 by pulling the strut 30 toward the center of the base portion 14. As such a pulling force is unlikely to be generated during the use of the trampoline, accidental disengagement of the strut 30 from the sleeves 31 and 32 is remote.

The widths of side viewing decks 21 and end viewing decks 25 are, of course, governed by the width of connecting members 23 and 27 respectively. As shown in FIGS. 2 and 3, the width of connecting members 23 and 27 has been chosen so as to be capable of supporting the average user's foot 40 without the necessity of further rigid support between the tubular members 26 and 22 and the perimeter frame 12. The width of connecting members 23 and 27 has been selected so that the average user's foot 40 rests comfortably on the heel and the ball of the foot. A platform completely surrounding the jumping surface of the trampoline is thereby provided on which users and instructors may stand without interfering with the spring action of the resilient surface of the trampoline. In fact, the enhanced rigidity which applicant's integrally constructed spotting decks provide to the overall trampoline structure, results in a frame which is minimally distorted by the impact of the user on the resilient surface. As a result, the bounce obtained on a trampoline embodying applicant's integrally constructed viewing decks is superior to any trampoline presently available.

To cushion the impact of any user who might inadvertently bounce onto one of the decks, both the side decks 21 and the end decks 25 are covered with a shock absorbing foam pad 36. The foam pad 36 may be covered by a tear resistent vinyl cover 37. Carried on the bottom of pad 36 is a semi-circular metal clip 38 which partially surrounds the perimeter frame 12 holding the pad 36 in place.

Figure 8:
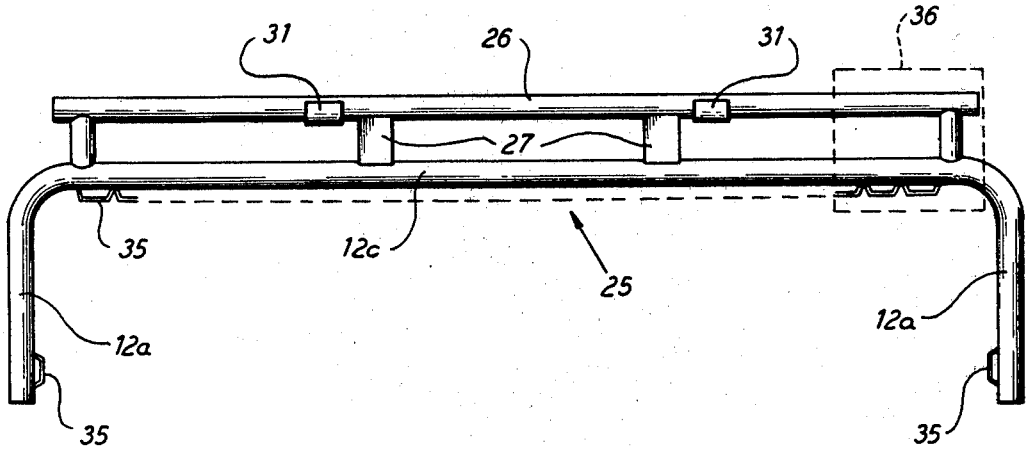
FIG. 8 is a plan view from below of a detached spotting and viewing deck of the type attachable to a rectangular trampoline as shown in FIG. 1.

Theend viewing deck shown fully assembled in a rectangular trampoline in FIG. 1 is shown detached in FIG. 8, as viewed from below. Elements common to both FIGS. 1 and 8 are identified with identical reference numerals, with the portion of the frame 12 which is encompassed by the separable viewing deck referenced with two parallel side legs **12*a* which curve to join a central straight portion 12*c* which, when assembled, forms the shorter sides of the rectangular perimeter 12. The legs 12*a* are removably telescopically connected with the straight side portions of the frame 12 to form an essentially continuous, though separable, rectangular perimeter. The position of the foam covering 36 is indicated in portion by the dashed lines, however, the rigid platform 45 shown in FIG. 6** may also be utilized in the same position.

Figure 9:
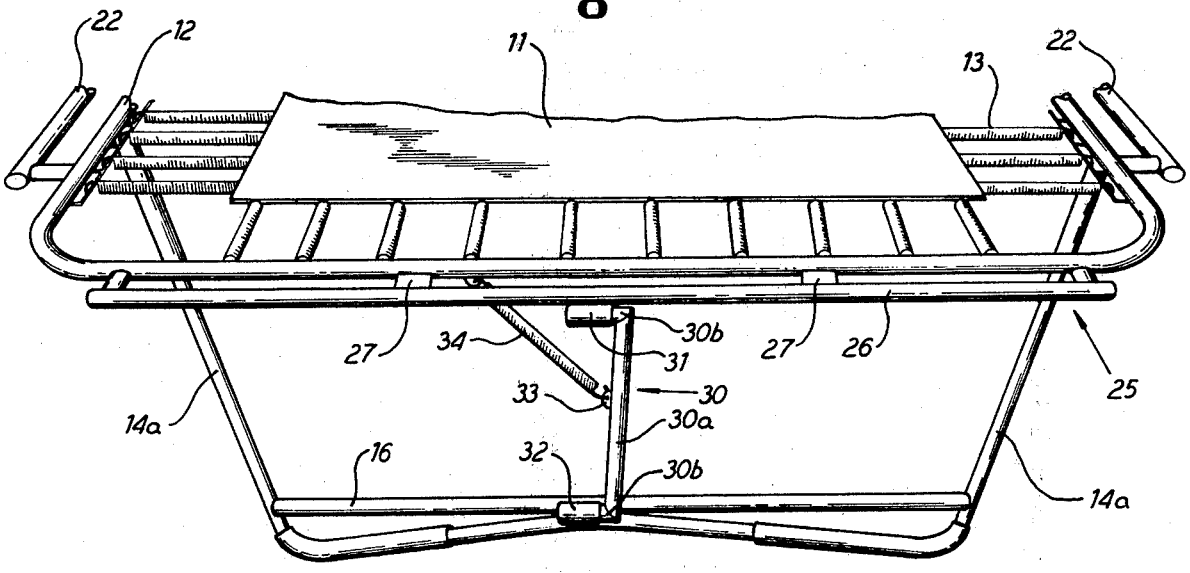
FIG. 9 is an embodiment of the viewing deck utilizing a single support.

A further embodiment is shown in FIG. 9, wherein elements common to FIG. 1 are referenced with identical reference numerals. The embodiment of FIG. 9 utilizes a single supporting strut 30 which is centrally disposed beneath the viewing deck 25 in a manner similar to that shown in FIG. 1 for the two strut embodiment. The single strut 30 has a central portion **30*a* and legs 30*b* which are respectively received in sleeves 31 and 32. The strut 30 is retained by a tensioned spring 34 extending from a flange 33 to the perimeter 12**.

It will be further understood that although backyard trampolines as described above are generally characterized by four rigid elements connected to form a rectangular perimeter frame, that the longer side rails of the rectangular perimeter may in fact be formed by joined intersecting smaller rod members to facilitate disassembly and storage thereof, instead of a single one piece side rail. The attachment of the shorter pieces is, however, made such that the complete side rail is still rigid, and is not hinged or foldable as are the side rails for the institutional trampolines.

Figure 6:
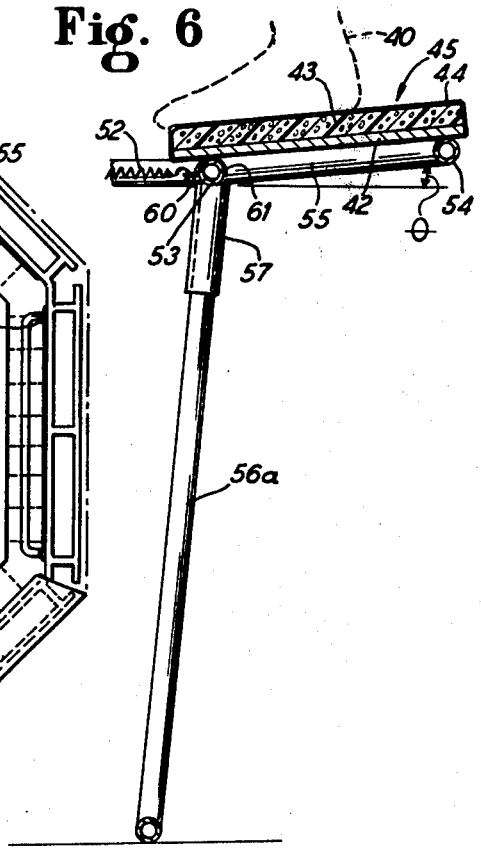
FIG. 6 is a sectional view taken on line VI—VI of FIG. 5.

A second embodiment is shown in FIG. 6, which, although in the drawing is constructed as part of the octagonal trampoline of FIG. 5, is equally adaptable to a rectangular or circular trampoline. In FIG. 6, the connecting member 55 serves the same structural purpose as connecting members 23 and 27 in the rectangular embodiment. Connecting member 55 has been extended beyond the length of the average user's foot 40, thereby requiring some additional support means to cover the gap between the perimeter 53 of the trampoline and the outer tubular member 54. Such support is provided by a platform 45, which consists of a rigid flat base 42, which may be made of $\frac{5}{8}$ inch thick plywood, a shock absorbant foam pad 43, and a vinyl covering 44. A semi-circular clip 61, attached to the bottom of the platform 45, partially surrounds the perimeter frame 53, holding the platform in place. With the use of said platform 45, connecting members 23 & 27, or 55 or 77 may be lengthened to as much as 32 inches.

Applicant's deck construction can be easily adapted to trampolines of geometric forms other than rectangular. FIG. 5 shows an octagon-shaped trampoline embodying applicant's deck construction and those versed in the art will recognize the desirability of embodying the inventive concept in a trampoline of any geometric configuration.

The trampoline 50 consists of an octagon-shaped perimeter 53 which supports a similarly shaped resilient surface 51. A plurality of springs 52 retain the resilient surface 51 in coplanar relation to the perimeter 53 when no force is exerted on the resilient surface 51. Supporting members or legs 56 are disposed beneath alternate sides of the trampoline 50. Supporting member 56 consists of a generally U-shaped tubular member, having generally upright portions **56*a* and a base portion 56*b* on which the trampoline rests on a supporting surface. The uppermost ends of the upright portions 56*a* engage sleeves 57, attached beneath and extending downwardly from the perimeter 53**.

A viewing deck is constructed on each side of trampoline 50, consisting of an outer tubular member 54 and a plurality of connecting members 55, disposed perpendicularly to said outer member 54 and a side of the perimeter 53. The width of the connecting member 55 may be chosen so as to support a human foot 40 without additional means, as shown generally in FIG. 2, or may be extended as shown in the version of FIG. 6, which utilizes the rigid platform 45. The platforms 45, or similarly shaped vinyl and foam coverings, are mitered at an appropriate angle at joints 58, to provide a continuous surface surrounding the trampoline 50.

As shown in FIG. 6, but not necessarily limited to the octagonal configuration, the decks surrounding the trampoline may be disposed upwardly at an angle $\theta$ from the plane of the resilient surface 51. The angle $\theta$ may be varied between 5° and 10°. Such a configuration will aid in preventing those standing on the spotting decks from falling backwards off the trampoline, and will also aid in the use of training devices, such as the belt-and-rope apparatus described earlier.

Figure 7:
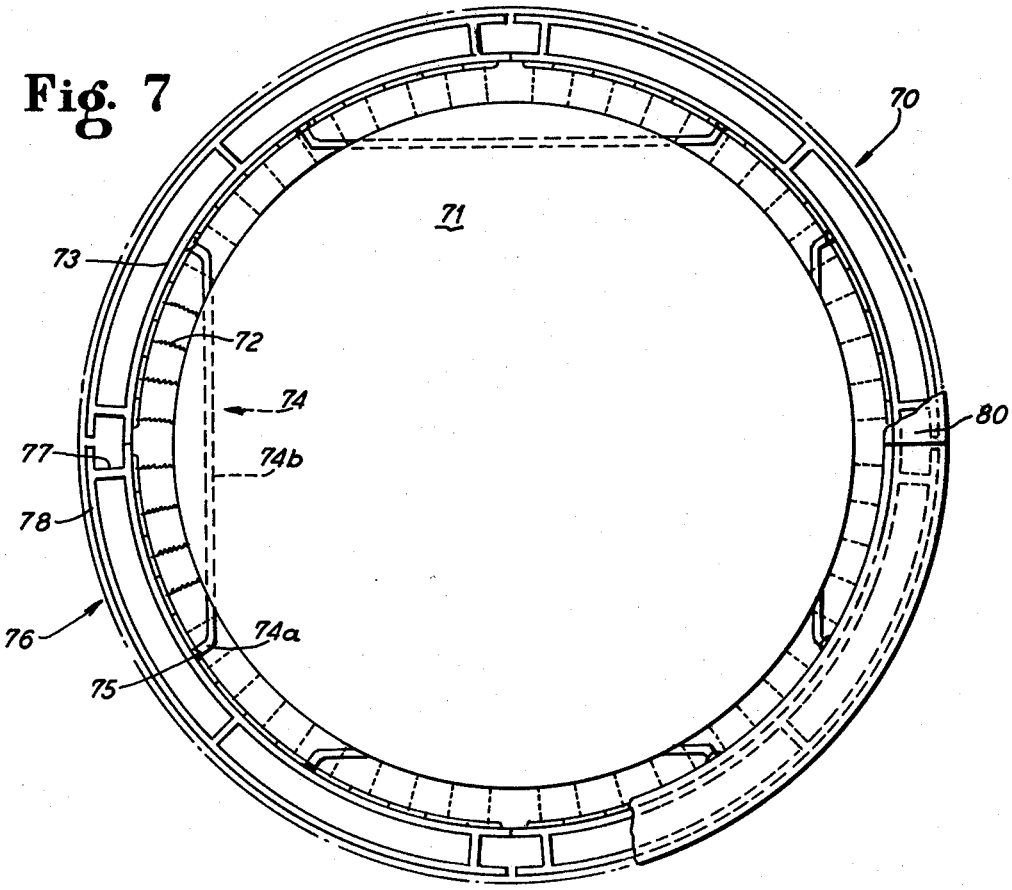
FIG. 7 is a plan elevational view of a circular trampoline carrying a circular viewing deck.

FIG. 7 shows a circular trampoline 70 having a viewing deck completely surrounding its circumference. Circular trampoline 70 consists of a tubular perimeter 73, a circular resilient surface 71, and a plurality of springs 72, holding said resilient surface 71 coplanar with the perimeter 73 when no force is exerted thereon.

Four supporting members or legs 74 are disposed generally in a square beneath the perimeter 73 and attached thereto by engagement in sleeves 75 extending downwardly from the perimeter 73. Supporting member 74 consists of two generally upright portions 74*a*, the uppermost ends of which engage sleeves 75, and a base portion 74*b* upon which the trampoline 70 rests on a supporting surface.

The viewing deck 76 surrounding the resilient surface 71 is constructed in four sections, each section comprising an outer tubular member 78, which forms a portion of an arc of the circle concentric with resilient surface 71, and a plurality of connecting members 77 which are segments of radii of a circle having its center at the center of resilient surface 71 and which are attached to the perimeter 73 and the outer tubular member 78 by a suitable means such as welding.

Viewing deck 76 may be of the narrower width shown generally in FIG. 2, capable of supporting the user's foot 40 without additional means, or of the widened embodiment shown in FIG. 6, utilizing the additional support platform 45. Also, the spotting deck 76 may be disposed substantially coplanar with the resilient surface 71 or slanted upwards by an angle $\theta$, as also shown in FIG. 6. The foam covering 36 or the platform 45 may be attached to the perimeter 73 of the circular trampoline 70 by use of either clips 38 or 61 respectively.

Various minor modifications may be suggested by those skilled in the art. In particular, the spotting decks carried on any of the three geometric shapes of the trampolines disclosed herein may be constructed of a continuous outer member surrounding the trampoline, instead of the segmented construction which applicant has disclosed. The decks surrounding the circular trampoline need not be segmented into four portions, any number of arcs of equal or unequal length which substantially surround the circular trampoline may be utilized. The connecting members connecting the inner perimeter which supports the resilient bouncing surface of the rectangular and octagon trampolines to the outer perimeter of the spotting deck need not be in perpendicular relation to the frame and outer perimeter, but may be disposed at any angle between the frame and the perimeter. The connecting members may thus be disposed in an "X" or "W" pattern, or other suitable patterns. Applicant's spotting decks may also be employed on trampolines having a hinged frame for more compact storage. Hinges could be placed at any appropriate position along the deck so as to allow for folding of the trampoline. The supporting end struts shown in applicant's rectangular trampoline could also be employed in the circular and octagon trampolines disclosed. It should be understood that the applicant wishes to embody within the scope of the patent warranted hereon all modifications as reasonably and properly come within the scope of applicant's contribution to the art.

I claim as my invention:

1. In a backyard trampoline of the type having a rectangular resilient surface-supporting frame with a pair of rigid sides of equal length each side having a rigid outer member connected to said side in spaced relation along the entire length of said side, the improvement of a supporting and viewing end structure removably attachable to said sides at each end of said trampoline, said structure comprising:

a pair of downwardly extending first sleeves attached beneath and at opposite sides of said frame inwardly of each said end structure;

a W-shaped leg having a pair of upper ends respectively removably received in said first sleeves and having a base portion resting on the ground;

each said end structure comprising a pair of spaced parallel tubular members, one of said tubular members adapted to form together with the pair of sides the surface-supporting frame, and the other of said tubular members forming a foot-supporting element;

a plurality of connecting members extending between said tubular members, said foot-supporting element, said connecting members and said one of said tubular members cooperatively forming an end viewing deck adapted to be substantially coplanar with the resilient surface and said end viewing deck in combination with said outer members connected to said sides forming a segmented viewing and spotting deck which completely surrounds said resilient surface;

a pair of spaced lateral second sleeves attached to and extending beneath said foot-supporting element so as to divide said foot-supporting element substantially into thirds;

a pair of spaced lateral third sleeves carried on said base portion of said W-shaped leg in registry with said second sleeves;

a pair of U-shaped struts having an elongated bight portion extending generally vertically between the deck and the ground and having leg portions respectively received in one of said second sleeves and in one of said third sleeves; and a retainer spring connected between each said strut and said one of said tubular members for spring loading and retaining said struts in said sleeves whereby said W-shaped leg is removably attached to said frame by inserting said ends of said W-shaped leg into said first sleeves and respectively inserting said leg portions of said struts in said second and third sleeves.

2. The improvement of claim 1 wherein said segmented viewing and spotting deck is disposed at an angle above a plane containing said frame and said resilient surface.

3. The improvement of claim 2 wherein said angle is between 5° and 10°.

4. The improvement of claim 1 wherein said foot-supporting element is disposed parallel to said one of said tubular members at a distance from said one of said tubular members less than the length of an average user's foot and said viewing deck is covered with a shock absorbing mat affixed to said frame and to each of said outer members and said foot-supporting elements.

5. The improvement of claim 1 wherein said foot-supporting member is disposed parallel to said one of said tubular members at a distance from said one of said tubular members greater than the length of an average user's foot and said viewing deck is covered with a rigid, flat platform, said platform being covered with a shock absorbing material and being affixed to said frame and to each of said outer members and said foot-supporting elements.

6. The improvement of claim 1 wherein said rigid sides of said frame are each one-piece sides.

7. The improvement of claim 1 wherein said rigid sides of said frame are comprised of a plurality of releasably joined straight elements consecutively inserted to form a straight rigid side rail.

* * * * *